US007462010B1

(12) United States Patent
Wittek, Jr. et al.

(10) Patent No.: US 7,462,010 B1
(45) Date of Patent: Dec. 9, 2008

(54) GOLF BALL COLLECTION APPARATUS WITH REVERSAL PROTECTION

(75) Inventors: Robert Wittek, Jr., Park Ridge, IL (US); Aron Cantrell, River Grove, IL (US)

(73) Assignee: Wittek Golf Supply Company Inc., Chicago, IL (US)

( * ) Notice: Subject to any disclaimer, the term of this patent is extended or adjusted under 35 U.S.C. 154(b) by 102 days.

(21) Appl. No.: 11/364,459

(22) Filed: Feb. 28, 2006

(51) Int. Cl.
*B60P 1/00* (2006.01)

(52) U.S. Cl. ..... 414/440; 414/338; 56/328.1

(58) Field of Classification Search ..... 414/440, 414/338; 56/328.1
See application file for complete search history.

(56) References Cited

U.S. PATENT DOCUMENTS

| | | | | |
|---|---|---|---|---|
| 1,565,162 | A | 12/1925 | King | |
| 2,365,540 | A | 12/1944 | Fonken | |
| 2,482,355 | A | 9/1949 | McBride | |
| 2,539,596 | A | 1/1951 | Smith | |
| 2,605,005 | A | 7/1952 | Wenzel et al. | |
| 2,656,061 | A | 10/1953 | Lockie | |
| 2,792,955 | A | 5/1957 | Sumner | |
| 3,175,714 | A | 3/1965 | Wittek | |
| 3,306,480 | A * | 2/1967 | Wysong | 414/440 |
| 3,784,037 | A | 1/1974 | Woodall | |
| 3,995,759 | A | 12/1976 | Hollrock | |
| 4,593,519 | A | 6/1986 | Kimball | |
| 4,792,271 | A | 12/1988 | Akel | |
| 5,141,383 | A | 8/1992 | Phillips et al. | |
| 5,149,245 | A * | 9/1992 | Landmann | 414/440 |
| 5,882,169 | A * | 3/1999 | Tucek | 414/440 |
| 6,443,684 | B2 | 9/2002 | Tucek | |
| 7,134,828 | B2 * | 11/2006 | Knez | 414/436 |

* cited by examiner

*Primary Examiner*—Michael S Lowe
(74) *Attorney, Agent, or Firm*—Marshall, Gerstein & Borun LLP

(57) ABSTRACT

A golfball collecting apparatus is provided including a frame and at least first and second discs mounted to the frame for rotation about an axis, the first and second discs having facing surfaces defining a space therebetween in which golf balls become lodged at a first angular position relative to the axis and are carried with the first and second discs about the axis from the first angular position. A first finger is attached to the frame and has a first end disposed in the space to dislodge golf balls carried with the first and second discs about the axis in a first direction about the axis. A second finger is attached to the frame and has a surface disposed in the space between the first angular location and the end of the first finger to dislodge golf balls carried with the first and second discs about the axis in a second direction about the axis.

19 Claims, 3 Drawing Sheets

GOLF BALL COLLECTION APPARATUS WITH REVERSAL PROTECTION

FIELD OF THE INVENTION

The present invention is directed to a golfball collecting apparatus including rotating discs which trap golf balls in a space therebetween, and in particular, to a golfball collecting apparatus including rotating discs which trap golf balls in a space therebetween and a dislodging mechanism effective to dislodge the golfballs from the space regardless of the direction in which the discs rotate.

BACKGROUND

It is known in the art to provide a golf ball collecting apparatus, or picker, that includes a frame to which a plurality of discs are mounted for rotation about an axis. See U.S. Pat. No. 3,175,714. The discs have facing surfaces which define spaces therebetween in which golfballs may become lodged. The golf ball collecting apparatus also includes fingers which project into the spaces to dislodge the golf balls from in between the discs as the discs rotate about the axis in a first direction. The dislodged golf balls are then transferred to a basket wherein they are collected.

One difficulty with such golf ball collecting apparatuses is that once the golf balls are lodged in the space between discs, the golfballs may be carried in either direction with the discs about the axis. Where the golf ball collecting apparatus is moving in a forward direction, the operation is as described above. However, if the golfball collecting apparatus reverses direction, the golfballs are carried with the discs about the axis in the opposite direction. Eventually, the golf balls collide with the reverse side of the fingers. This can cause damage to, and even eventual breakage of, the fingers over time.

It is also known in the art to use an L-shaped plate to define the finger. See U.S. Pat. No. 2,365,540. Specifically, the L-shaped plate has two legs which meet at a common vertex and extend therefrom to two spaced ends. The spaced end of one of the legs is cantilevered into the space between the discs by pinning the common vertex to the frame. The other leg is pinned to the frame at its end.

It is thought that this configuration may actually be less advantageous than the typical configuration discussed above. Specifically, it is believed that the surface of the pinned leg actually forces the golf balls deeper into the space between the discs when the direction is reversed. This causes the golfballs to contact the cantilevered leg even further from the common vertex, causing an even greater moment to be applied to the leg. This increased moment is thought to increase the stresses in the cantilevered leg.

It is further known in the art to provide a golf ball collecting apparatus which is operational both in the forward and reverse directions. See U.S. Pat. No. 2,482,355. Rather than using discs, wires are arranged like spokes about a central drum. The golf balls become lodged between adjacent spokes such that they are carried with the spokes about the axis of the drum. An ejector mechanism is also provided including bars arranged parallel to the drum axis and mounted about a shaft that has an axis eccentric to the drum axis. The ejector mechanism moves relative to the drum to dislodge the golf balls regardless of the direction of motion of the collecting apparatus.

While such an ejector mechanism may function regardless of the direction of motion of the collecting apparatus, it is thought to be unnecessarily complex. Additionally, given the rigors through which golf ball collecting apparatuses are normally put, it is believed that the apparatus described in the preceding paragraph lacks sufficient robustness. As a consequence, it is believed that a considerable amount of time will be required to maintain the golfball collecting apparatus, thereby limiting the amount of time the apparatus is available to perform its golf ball collecting duties.

SUMMARY

According to an aspect of the present invention, a golf ball collecting apparatus includes a frame and at least first and second discs mounted to the frame for rotation about an axis, the first and second discs having facing surfaces defining a space therebetween in which golf balls become lodged at a first angular position relative to the axis and are carried with the first and second discs about the axis from the first angular position. The golf ball collecting apparatus also includes a first finger attached to the frame and having a first end disposed in the space to dislodge golfballs carried with the first and second discs about the axis in a first direction about the axis, and a second finger attached to the frame and having a surface disposed in the space between the first angular location and the end of the first finger to dislodge golfballs carried with the first and second discs about the axis in a second direction about the axis.

The second finger may have a first end disposed in the space between the first angular location and the first end of the first finger. The first and second fingers may be cantilevered from the frame such that the first ends of the first and second fingers are free. The first and second fingers may each have a second end which is attached to the frame at a common point, such that the first and second fingers define an acute angle therebetween.

Moreover, the golfball collecting apparatus may include a bent plate attached to the frame, the bent plate defining the first and second fingers.

The first and second discs may each have an annular groove formed in the facing surfaces, the grooves receiving golf balls therein so that the golf balls are carried with the first and second discs about the axis.

The golf ball collecting apparatus may also include a motorized vehicle attached to the frame. Alternatively, the golf ball collecting apparatus may include a handle attached to the frame. Furthermore, the golf ball collecting apparatus may include a basket attached to the frame proximate to the first finger to collect golf balls dislodged from the space.

According to another aspect of the present invention, a golf ball collecting apparatus includes a frame, and a first plurality of discs mounted to the frame for rotation about a first axis. Inner pairs of the first plurality of discs have facing surfaces defining a space therebetween in which golfballs become lodged at a first angular position relative to the first axis and are carried with the inner pairs of the first plurality of discs about the first axis from the first angular position. The golf ball collecting apparatus also includes a first plate attached to the frame. The first plate defines a plurality of first fingers, at least one of the plurality of first fingers having a first end disposed in the space defined by one of the inner pairs of the first plurality of discs to dislodge golf balls carried with the one of the inner pairs about the first axis in a first direction about the first axis. The first plate also defines a plurality of second fingers, at least one of the plurality of second fingers associated with the at least one of the plurality of first fingers and having a surface disposed in the space defined by the one of the inner pairs of the first plurality of discs between the first angular location and the end of the at least one of the plurality of first fingers to dislodge golfballs carried with the one of the inner pairs about the first axis in a second direction about the first axis.

Each one of the plurality of first fingers of the first plate may also have a first end disposed in the space defined by one of the inner pairs of the first plurality of discs to dislodge golf balls carried with the one of the inner pairs about the first axis in a first direction about the first axis. In such a case, each one of the plurality of second fingers of the first plate may be associated with one of the plurality of first fingers and may have a surface disposed in the space defined by the one of the inner pairs of the first plurality of discs between the first angular location and the end of the one of the plurality of first fingers to dislodge golf balls carried with the one of the inner pairs about the first axis in a second direction about the first axis.

The golf ball collecting apparatus may also include a second plurality of discs mounted to the frame for rotation about a second axis. Inner pairs of the second plurality of discs may have facing surfaces defining a space therebetween in which golf balls become lodged at a first angular position relative to the second axis and are carried with the inner pairs of the second plurality of discs about the second axis from the first angular position. The golf ball collecting apparatus may further include a second plate attached to the frame, the second plate defining a plurality of first fingers. At least one of the plurality of first fingers may have a first end disposed in the space defined by one of the inner pairs of the second plurality of discs to dislodge golfballs carried with the one of the inner pairs about the second axis in a first direction about the second axis. The second plate may also define a plurality of second fingers, at least one of the plurality of second fingers associated with the at least one of the plurality of first fingers and having a surface disposed in the space defined by the one of the inner pairs of the second plurality of discs between the first angular location and the end of the at least one of the plurality of first fingers to dislodge golf balls carried with the one of the inner pairs about the second axis in a second direction about the second axis. The second plurality of discs may be spaced from the first plurality of discs.

Moreover, each one of the plurality of first fingers of the second plate may have a first end disposed in the space defined by one of the inner pairs of the second plurality of discs to dislodge golf balls carried with the one of the inner pairs about the second axis in a first direction about the second axis. Each one of the plurality of second fingers of the second plate may be associated with one of the plurality of first fingers and may have a surface disposed in the space defined by the one of the inner pairs of the second plurality of discs between the first angular location and the end of the one of the plurality of first fingers of the second plate to dislodge golf balls carried with the one of the inner pairs about the second axis in a second direction about the second axis.

The golf ball collecting apparatus may further include a motorized vehicle attached to the frame. Additionally, the first and second axes may be collinear. Alternatively, the first and second axes may be parallel but not collinear.

BRIEF DESCRIPTION OF THE EMBODIMENTS

Figure 1:
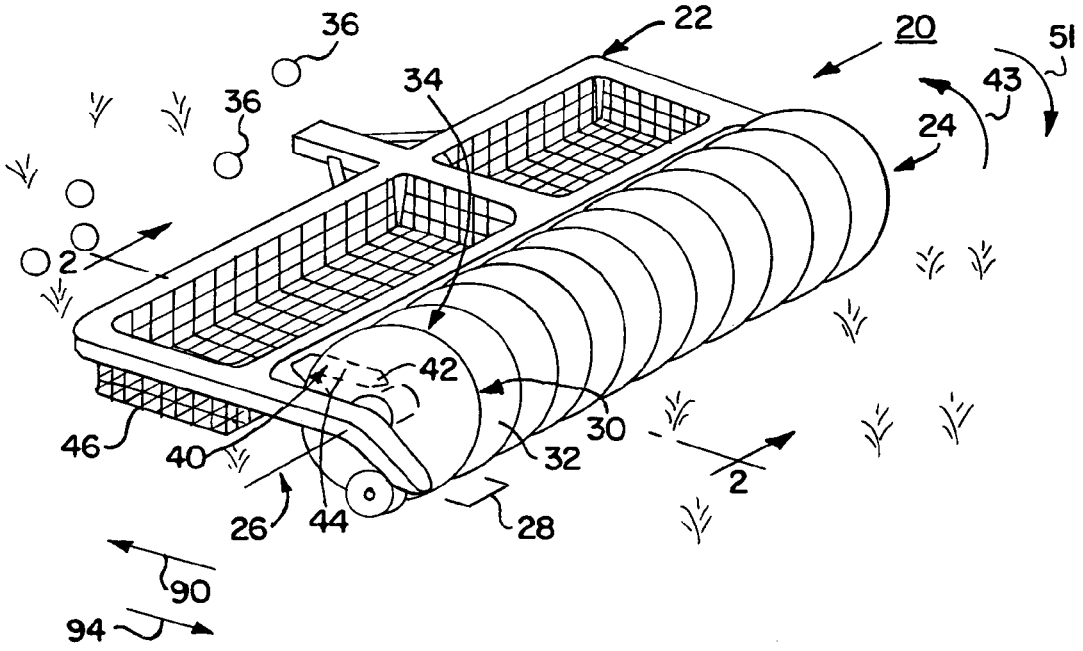
FIG. 1 is a perspective view of a golf ball collecting apparatus.
Figure 2:
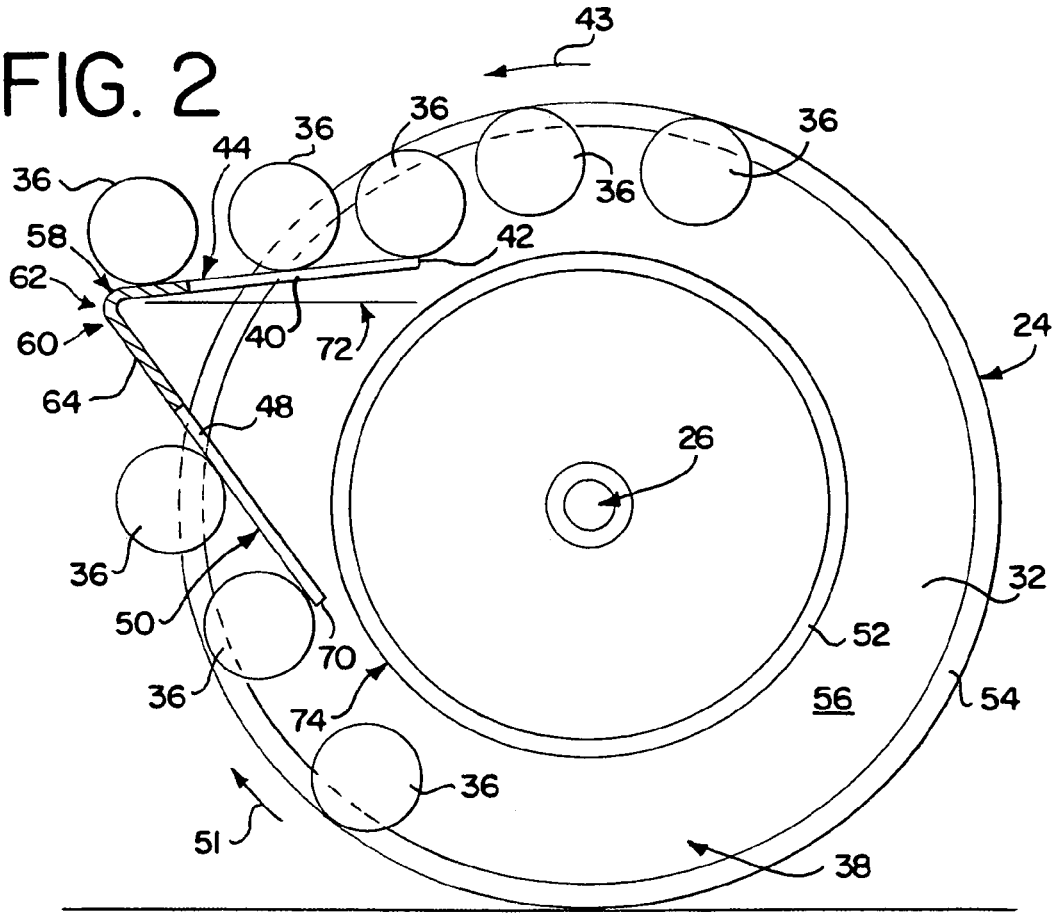
FIG. 2 is a cross-sectional view of the golf ball collecting apparatus of FIG. 1 taken about line 2-2 of FIG. 1.

A golf ball collecting apparatus 20 is shown in FIGS. 1 and 2. The golf ball collecting apparatus includes a frame 22 and a plurality of discs 24 mounted about an axis 26. Inner pairs 28 of the discs 24 have facing surfaces 30, 32 which define a space 34 therebetween. Golf balls 36 may become randomly lodged in the space 34 at any angular position, such as that hereinafter referred to as the first angular position 38. The golf ball collecting apparatus 20 also includes a plurality of fingers 40 which are attached to the frame 22 and have a first end 42 disposed in the space 34 to dislodge golf balls 36 carried with the discs 24 about the axis 26 in a first direction represented by an arrow 43. Golf balls 36 dislodged by the fingers 40 travel along the length of surface 44 and into a basket 46 which is attached to the frame 22 proximate to the finger 40 to collect golf balls 36 dislodged from the space 34. The golf ball collecting apparatus 20 also includes a finger 48 which is attached to the frame 22. The finger 48 is best seen in FIG. 2. The finger 48 has a surface 50 which is disposed in the space 34 between the first angular position 38 and the end 42 of the finger 40. The surface 50 causes the golfballs 36 to be dislodged from the space 34 as the golf balls 36 are carried with the discs 24 about the axis 26 in a second direction represented by an arrow 51. The finger 48 thus serves as a protection device for the finger 40.

That is, in a normal mode of operation, the golf balls 36 will be dislodged from the space 34 by the finger 40. If the golf ball collecting apparatus has its direction of motion reversed, such that the golf balls 36 do not move in the direction of the finger 40 but in the opposite direction, the finger 48 will contact the golf balls 36 first and dislodge them from the space 34. In this fashion, the golf balls 36 will be removed from the space 34 before they can contact the underside of the finger 40 as viewed in FIG. 2, causing damage and/or breakage of the finger 40. By limiting the possibility of damage to the finger 40, it is believed that the amount of maintenance required to repair broken or damaged fingers will be limited, thereby increasing the amount of time the golf ball collecting apparatus 20 is available to perform its primary function of collecting golfballs 36.

The structure of the golf ball collecting apparatus 20 is now discussed in greater detail with reference to FIG. 2. The discs 24 are preferably circular, and have facing surfaces, such as the surface 32 which is shown, that are preferably planar. Two raised rings 52, 54 depend from these planar facing surfaces. The rings 52, 54 serve with the planar surface 32 to define an annular groove 56. The annular groove 56 serves to position the balls 36 at a relatively consistent radius relative to the axis 26. By maintaining the golf balls 36 at a fairly consistent radius relative to the axis 26, more precise placement of the fingers 40, 48 may be made. According to a most preferred embodiment, the ring 52 depends a greater distance from the surface 32 of the disc 24 than the ring 54.

Figure 3:
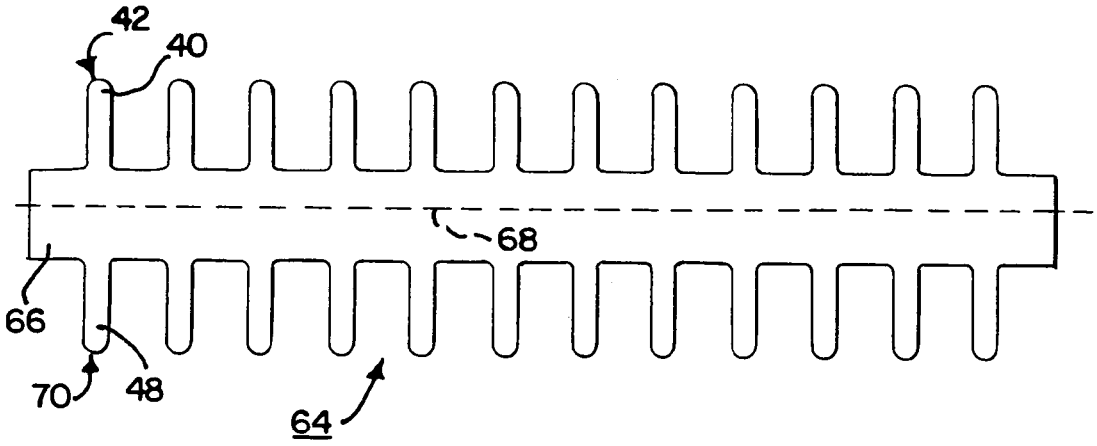
FIG. 3 is a plan view of a plate defining first and second fingers used in the golf ball collecting apparatus of FIG. 1.

It will be further noted with reference to FIG. 2 that the fingers 40, 48 have ends 58, 60 which are attached at a common point 62 to the frame 22. In a most preferred embodiment, the fingers 40, 48 are integrally formed and defined by a plate 64. The plate 64 is shown in a pre-bent state in FIG. 3. As will be seen, the plate 64 has a central portion 66 from which depend the fingers 40, 48. The central portion 66 of the plate 64 is bent along a bend line 68 which is disposed such that the distance between the bend line 68 and the end 42 of the finger 40 is less than the distance between the bend line 68 and an end 70 of the finger 48. The bend line 68 will also serve as the common point 62 of attachment of the fingers 40, 48 to the frame 22.

The plate 64 is bent about the bend line 68 to assume a V-shaped form. In particular, the plate 64 is bent such that the fingers 40, 48 define an acute angle therebetween. Preferably, but not necessarily, the acute angle is approximately 60 degrees.

Returning now to FIG. 2, it will be recognized that the finger 40, which is preferably planar, has its surface 44 disposed at a slight angle relative to the horizontal axis, represented by line 72. This slight angle relative to the horizontal allows the golf balls 36, once dislodged from the space 34, to travel smoothly along the surface 44 of the finger 40 and into the basket 46 disposed proximately to the second end 58 of the finger 40.

It will be further recognized that the end 70 of the finger 48 is disposed in the space 34 almost to the inner edge 74 of the inner ring 52. It will be noted that by disposing the end 70 of the finger 48 at this position, the surface 50 is disposed relative to the annular groove 56 so as to present the highest likelihood of contacting any golf ball 36 disposed within the annular groove 56.

Figure 4:
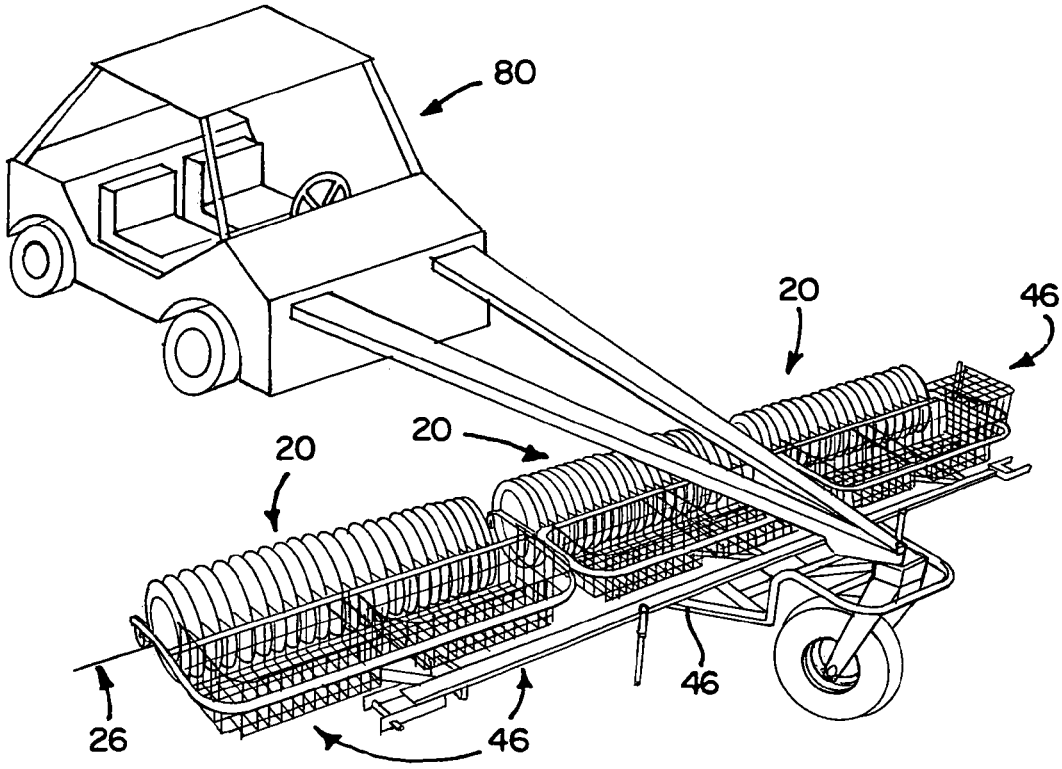
FIG. 4 is a perspective view of a plurality of golf ball collecting apparatuses coupled in straight-line fashion to a golf cart.
Figure 5:
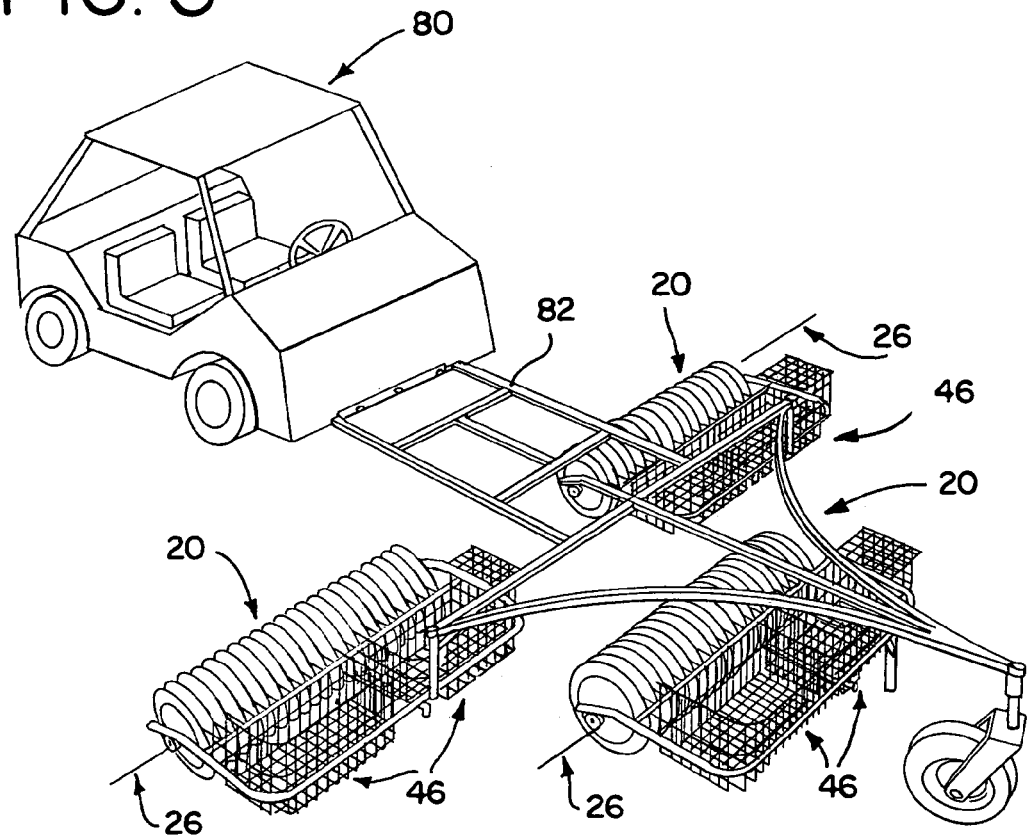
FIG. 5 is a perspective view of a plurality of golf ball collecting apparatuses coupled on outriggers to a golf cart.

The golf ball collecting apparatus 20 has numerous applications. For example, as shown in FIGS. 4 and 5, one or more golf ball collecting apparatuses 20 may be coupled to a golf cart 80 such that the golf cart 80 may be used to propel the golf ball collecting apparatuses 20 over a wide area. As shown more particularly in FIG. 4, a number of golfball collecting apparatuses 20 are coupled in straight-line fashion, such that the axes 26 of the individual golf ball collecting apparatuses 20 are collinear. As an alternative to this, as shown in FIG. 5, a number of golf ball collecting apparatuses 20 are connected to an intermediate frame 82 using devices commonly referred to as outriggers. In this arrangement, the golf ball collecting apparatuses 20 are arranged such that the axes 26 are parallel, but not all are collinear.

Figure 6:
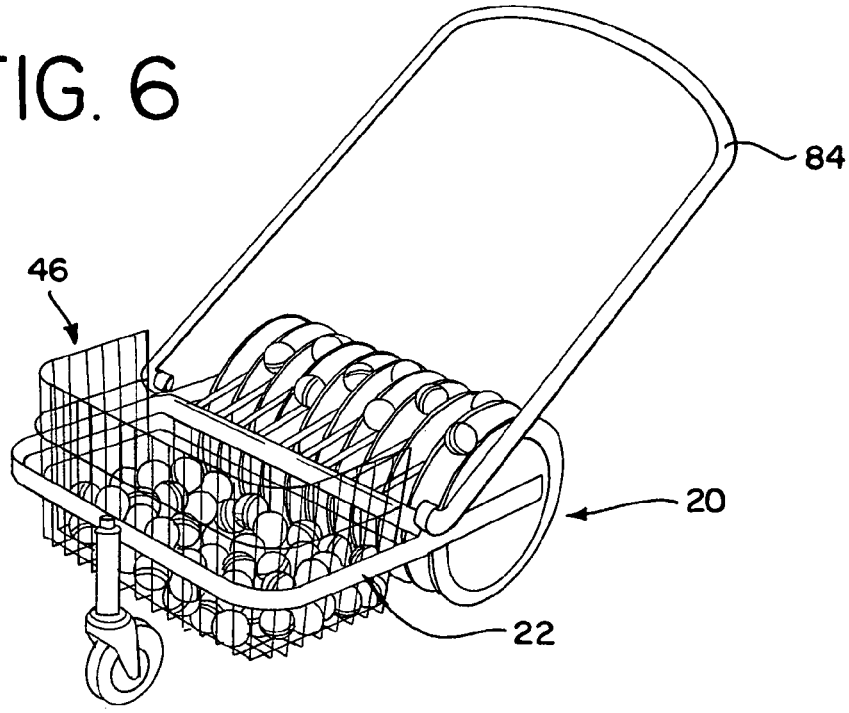
FIG. 6 is a perspective view of a golf ball collecting apparatus coupled to a handle for manual use.

A further variation of the golf ball collecting apparatus 20 is shown in FIG. 6. As seen in FIG. 6, a handle 84 is attached to the frame 22 to provide the means of propelling the golf ball collecting apparatus 20. The embodiment of the golf ball collecting apparatus 20 with handle 84 shown in FIG. 6 is for smaller area applications than the versions shown in FIGS. 4 and 5.

Returning once more to FIG. 1, the method of operation of the golf ball collecting apparatus 20 will be explained. As the frame 22 of the golfball collecting apparatus 20 is moved in the direction of an arrow 90, the axis 26 of the discs 24 is moved therewith in the same direction. As a consequence, the discs 24 rotate about the axis 26 in the direction of the curved arrow 43 (see also FIG. 2). This causes the golf balls 36 to become lodged in the spaces 34 defined between the discs 24 and carried with the discs 24 in the direction of the arrow 43. The golf balls 36 eventually contact the finger 40, whereupon they are dislodged from the annular groove 56 and travel along the surface 44 into the basket 46.

If the direction of motion of the frame 22, and consequently the axis 26, of the golf ball collecting apparatus 20 is reversed, such that the frame 22 is moving in the direction of the arrow 94, the direction of rotation of the discs 24 about the axis 26 also reverses, as represented by the curved arrow 51 (see also FIG. 2). The golf balls 36 are then carried with the discs 24 about the axis 26 until they contact the surface 50 of the finger 48. The surface 50 of the finger 48 causes the golf balls 36 to be dislodged from the annular groove 56 and ejected from the golf ball collecting apparatus 20 onto the ground. When the motion of the golf ball collecting apparatus 20 returns to the direction represented by the arrow 90, the balls that were ejected from the golf ball collecting apparatus 20 by the finger 48 may be collected for a second time, and transferred to the basket 46.

As will be recognized, the golf ball collecting apparatus 20 provides a system whereby the possibility of damage to the finger 40 is limited. This improvement is believed to increase not only the life of the fingers 40, but, as a consequence of the reduction in the amount of maintenance time required by such a golf ball collecting apparatus, to increase the amount of time that the golf ball collecting apparatus 20 may be in operation.

Modifications and alternative embodiments will be apparent to those skilled in the art in view of the foregoing description. This description is to be construed as illustrative only, and is for the purposes of teaching those skilled in the art the best mode of carrying out the invention. The details of the structure and method may be varied substantially without departing from the spirit of the invention, and an exclusive use of all modifications which come within the scope of the appendant claims is reserved.

The invention claimed is:

1. A golf ball collecting apparatus comprising:

a frame;

at least first and second discs mounted to the frame for rotation about an axis, the first and second discs having facing surfaces defining a space therebetween in which golf balls become lodged at a first angular position relative to the axis and are carried with the first and second discs about the axis from the first angular position;

a first finger fixedly attached to the frame and having a first end disposed in the space and configured such that the first finger alone will dislodge golf balls carried with the first and second discs about the axis in a first direction about the axis; and a second finger fixedly attached to the frame and having a surface disposed in the space between the first angular location and the first end of the first finger and depending into the space at least as far as the first end of the first finger and configured such that the second finger alone will dislodge golf balls carried with the first and second discs about the axis in a second direction about the axis;

a bent plate attached to the frame, the bent plate defining the first and second fingers.

2. The golf ball collecting apparatus according to claim 1, wherein the second finger has a first end disposed in the space between the first angular location and the first end of the first finger.

3. The golf ball collecting apparatus according to claim 2, wherein the first and second fingers are cantilevered from the frame such that the first ends of the first and second fingers are free.

4. The golf ball collecting apparatus according to claim 3, wherein the first and second fingers each have a second end which is attached to the frame at a common point, such that the first and second fingers define an acute angle therebetween.

5. The golf ball collecting apparatus of claim 4, wherein a first distance from the first end to the second end of the first finger is less than a second distance from the first end to the second end of the second finger.

6. The golf ball collecting apparatus according to claim 1, wherein the first and second discs each have an annular groove formed in the facing surfaces, the grooves receiving golf balls therein so that the golf balls are carried with the first and second discs about the axis.

7. The golf ball collecting apparatus according to claim 1, further comprising a motorized vehicle attached to the frame.

8. The golf ball collecting apparatus according to claim 1, further comprising a handle attached to the frame.

9. The golf ball collecting apparatus according to claim 1, further comprising a basket attached to the frame proximate to the first finger to collect golf balls dislodged from the space.

10. The golf ball collecting apparatus of claim 1, wherein the first and second fingers each have a second end attached to the frame at a common point, and a first distance from the first end to the second end of the first finger is less than a second distance from a first end to the second end of the second finger.

11. A golf ball collecting apparatus comprising:

a frame;

a first plurality of discs mounted to the frame for rotation about a first axis, inner pairs of the first plurality of discs having facing surfaces defining a space therebetween in which golf balls become lodged at a first angular position relative to the first axis and are carried with the inner pairs of the first plurality of discs about the first axis from the first angular position; and a first plate fixedly attached to the frame;

the first plate defining a plurality of first fingers, at least one of the plurality of first fingers having a first end disposed in the space defined by one of the inner pairs of the first plurality of discs and configured such that the at least one of the plurality of first fingers alone will dislodge golf balls carried with the one of the inner pairs about the first axis in a first direction about the first axis; and the first plate defining a plurality of second fingers, at least one of the plurality of second fingers associated with the at least one of the plurality of first fingers and having a surface disposed in the space defined by the one of the inner pairs of the first plurality of discs between the first angular location and the first end of the at least one of the plurality of first fingers and depending into the space at least as far as the end of the at least one of the plurality of first fingers and configured such that the at least one of the plurality of second fingers alone will dislodge golf balls carried with the one of the inner pairs about the first axis in a second direction about the first axis;

the first plate being a bent plate attached to the frame, the bent plate defining the plurality of first and the plurality of second fingers.

12. The golf ball collecting apparatus according to claim 11, wherein:

each one of the plurality of first fingers of the first plate has a first end disposed in the space defined by one of the inner pairs of the first plurality of discs to dislodge golf balls carried with the one of the inner pairs about the first axis in the first direction about the first axis; and each one of the plurality of second fingers of the first plate is associated with one of the plurality of first fingers and has a surface disposed in the space defined by the one of the inner pairs of the first plurality of discs between the first angular location and the end of the one of the plurality of first fingers to dislodge golf balls carried with the one of the inner pairs about the first axis in the second direction about the first axis.

13. The golf ball collecting apparatus according to claim 11, further comprising:

a second plurality of discs mounted to the frame for rotation about a second axis, inner pairs of the second plurality of discs having facing surfaces defining a space therebetween in which golf balls become lodged at a first angular position relative to the second axis and are carried with the inner pairs of the second plurality of discs about the second axis from the first angular position relative to the second axis; and a second plate attached to the frame;

the second plate defining a plurality of first fingers, at least one of the plurality of first fingers of the second plate having a first end disposed in the space defined by one of the inner pairs of the second plurality of discs to dislodge golf balls carried with the one of the inner pairs about the second axis in the first direction about the second axis; and the second plate defining a plurality of second fingers, at least one of the plurality of second fingers of the second plate associated with the at least one of the plurality of first fingers of the second plate and having a surface disposed in the space defined by the one of the inner pairs of the second plurality of discs between the first angular location relative to the second axis and the first end of the at least one of the plurality of first fingers of the second plate to dislodge golf balls carried with the one of the inner pairs about the second axis in the second direction about the second axis, the second plurality of discs spaced from the first plurality of discs.

14. The golf ball collecting apparatus according to claim 13, wherein:

each one of the plurality of first fingers of the second plate has a first end disposed in the space defined by one of the inner pairs of the second plurality of discs to dislodge golf balls carried with the one of the inner pairs about the second axis in the first direction about the second axis; and each one of the plurality of second fingers of the second plate is associated with one of the plurality of first fingers of the second plate and has a surface disposed in the space defined by the one of the inner pairs of the second plurality of discs between the first angular location relative to the second axis and the end of the one of the plurality of first fingers of the second plate to dislodge golf balls carried with the one of the inner pairs about the second axis in the second direction about the second axis.

15. The golf ball collecting apparatus of claim 14, wherein each one of the plurality of first and second fingers of the second plate has a second end, and a first distance from the first end to the second end of each one of the plurality of first fingers of the second plate is less than a second distance from a first end to the second end of each one of the plurality of second fingers of the second plate.

16. The golf ball collecting apparatus according to claim 13, further comprising a motorized vehicle attached to the frame.

17. The golf ball collecting apparatus according to claim 16, wherein the first and second axes are collinear.

18. The golf ball collecting apparatus according to claim 16, wherein the first and second axes are parallel.

19. The golf ball collecting apparatus of claim 11, wherein the at least one of the plurality of first and second fingers each have a second end, and a first distance from the first end to the second end of the at least one of the plurality of first fingers is less than a second distance from a first end to the second end of the at least one of the plurality of second fingers.

* * * * *